33-234 SR
6/20/78 OR 4,095,347

United States Patent [19]

Steffan

[11] 4,095,347

[45] Jun. 20, 1978

[54] SIGHTING IN APPARATUS FOR RIFLE MOUNTED TELESCOPE GUNSIGHTS

[76] Inventor: Walter J. Steffan, 17838 SE. Lincoln St., Portland, Oreg. 97233

[21] Appl. No.: 794,221

[22] Filed: May 5, 1977

Related U.S. Application Data

[63] Continuation-in-part of Ser. No. 613,891, Sep. 16, 1975, abandoned.

[51] Int. Cl.[2] ..... F41G 1/38; G01C 15/08

[52] U.S. Cl. ..... 33/234; 33/245; 33/295

[58] Field of Search ..... 33/234, 245, 252, 295

[56] References Cited

U.S. PATENT DOCUMENTS

| | | | |
|---|---|---|---|
| 1,295,075 | 11/1916 | Sheppard | 33/234 |
| 3,112,567 | 12/1963 | Flanagan | 33/234 |
| 3,744,133 | 7/1973 | Fukushima | 33/234 |
| 3,908,282 | 9/1975 | Steffan | 33/234 |

*Primary Examiner*—Steven L. Stephan
*Attorney, Agent, or Firm*—Eugene M. Eckelman

[57] ABSTRACT

A support rod is adjustably secured to a gauge body which is counterweighted at its lower end such that it will hang upright in a pendulum arrangement when the rod is inserted in the muzzle end of a gun barrel. A vertically adjustable sighting target is mounted on the sighting gauge. A holder attachment having radially adjustable chuck-type jaws and arranged to support a lens is adapted to be mounted on the front of a telescope gunsight. The lens brings the sighting target into focus through the telescope. The holder attachment supports a first removable insert at its front end which has the lens therein, and this attachment is arranged to support a second insert on the other end having a peep-hole therethrough for more precisely aligning the telescope with the indicia on the sighting target. The holder attachment is also arranged to support the second insert in lieu of the first insert whereby a second holder attachment with the second insert therein can be mounted on the rear of the telescope and used in combination with a first insert on a holder on the front of the telescope to provide still greater accuracy for sighting in the gunsight.

5 Claims, 11 Drawing Figures

SIGHTING IN APPARATUS FOR RIFLE MOUNTED TELESCOPE GUNSIGHTS

REFERENCE TO PRIOR APPLICATIONS

This is a continuation in part of application Ser. No. 613,891, filed Sept. 16, 1975, now abandoned for Sighting In Apparatus For Rifle Mounted Telescope Gunsights.

BACKGROND OF THE INVENTION

This invention relates to new and useful improvements in sighting in apparatus for rifle mounted telescopes.

In my previous U.S. Pat. No. 3,908,282 I provided a sighting in apparatus for rifle mounted telescope gunsights employing a pendulum type sighting target for mounting in the muzzle of a rifle for the purpose of providing a sighting in apparatus which when once adapted to the particular rifle is used to readily sight in a telescope on the rifle to avoid the necessity of sighting in the rifle every year or every time the telescope is misaligned such as after the rifle has been accidentally dropped or the telescope otherwise is accidentally bumped.

SUMMARY OF THE INVENTION

According to the present invention and forming a primary objective thereof, sighting in apparatus of the type described is provided which amounts to improvements over my previous structure and more particularly to an improved sighting gauge arranged for better adaptation to various types of rifles and scope mounts and a focusing lens for better adaptation to telescopes of varying barrel sizes.

To accomplish such objectives, a sighting gauge body is provided with a longitudinal slot therethrough arranged to removably and adjustably receive a support rod on which the sighting gauge has pendulum support. The sighting gauge supports a sighting target which has vertical adjustment by means of a bottom adjusting screw. A holder attachment has chuck-like jaws adapted to be adjusted radially by means of a scroll type drive member having a spiral drive for engagement on telescope barrels of varying sizes. The holder attachment removably supports a lens insert and a peep-hole insert to provide accuracy in sighting in the rifle.

Figures 1, 2, 3, 4, 6, 9:
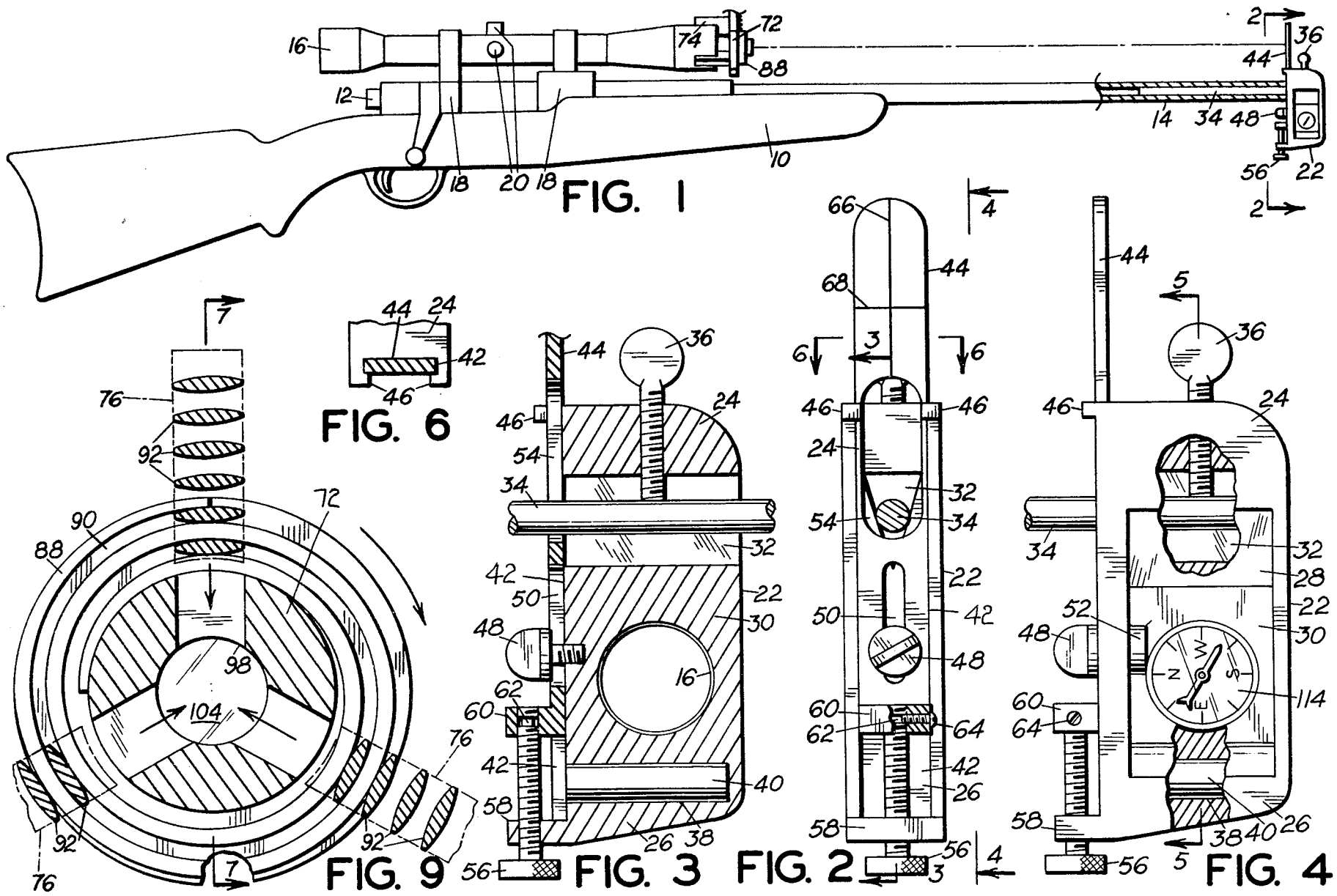
FIG. 1 is a side elevational view of a rifle having a telescope gunsight mounted thereon and showing the present invention in combination therewith for sighting in the gunsight.
FIG. 2 is an enlarged front elevational view of a sighting gauge forming a part of the present invention, this view being taken on the line 2—2 of FIG. 1.
FIG. 3 is a fragmentary vertical sectional view taken on the line 3—3 of FIG. 2.
FIG. 4 is a side elevational view, partly broken away, of the sighting gauge, this view being taken on the line 4—4 of FIG. 2.
FIG. 6 is a fragmentary horizontal sectional view taken on the line 6—6 of FIG. 2.
FIG. 9 is a sectional view taken on the line 9—9 of FIG. 7.
Figure 8:
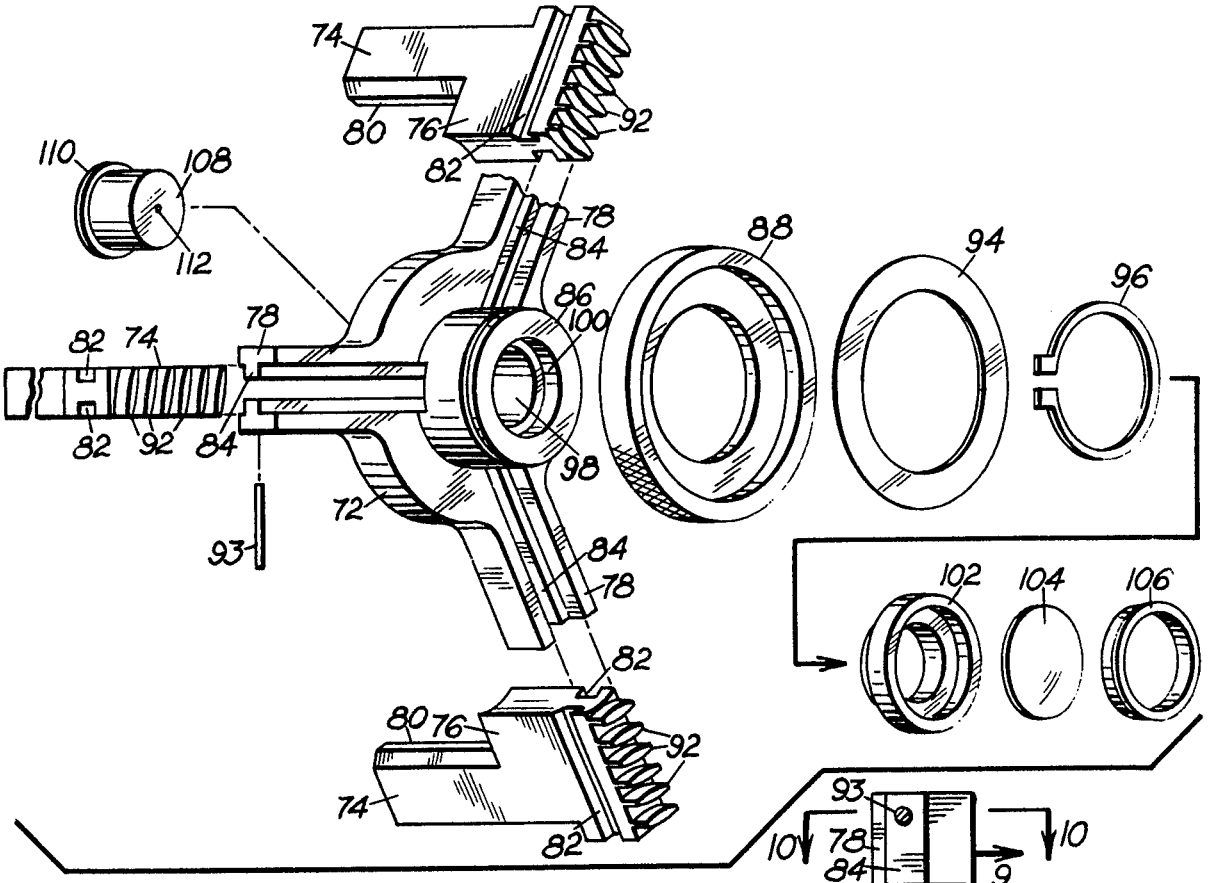
FIG. 8 is an exploded or assembly view of the chuck-type support.
Figure 5:
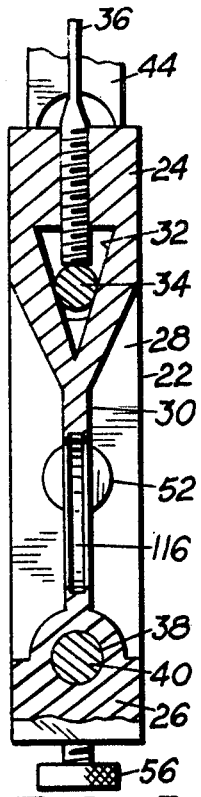
FIG. 5 is a sectional view taken on the line 5—5 of FIG. 4.
Figure 10:
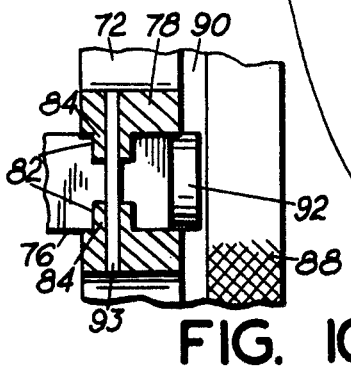
FIG. 10 is a fragmentary sectional view taken on the line 10—10 of FIG. 7.
Figure 7:
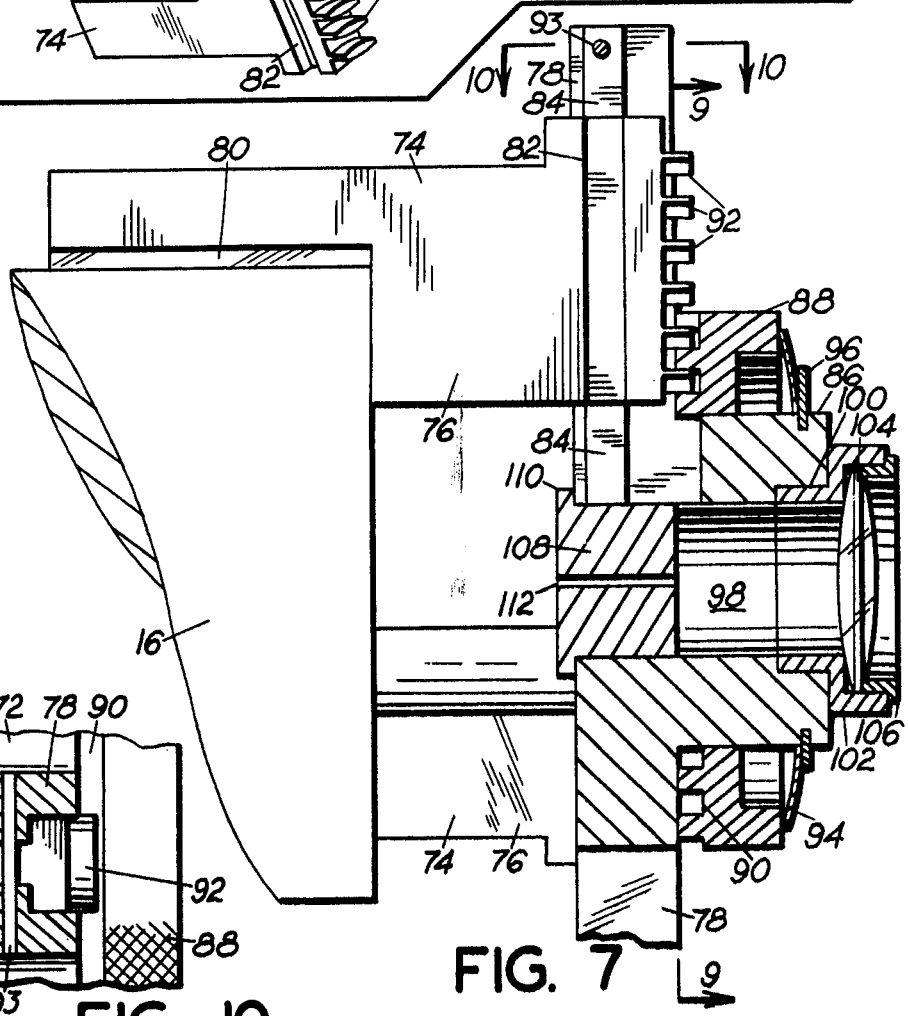
FIG. 7 is a sectional view of a chuck-type support attachment for mounting on a telescope gunsight, this view being taken on the line 7—7 of FIG. 9.

With reference first to FIG. 1, a conventional rifle is designated by the numeral 10. The breech portion of the barrel is designated by the numeral 12 and the muzzle portion is designated by the numeral 14. A telescope gunsight of conventional contruction is designated by the numeral 16 and has support on the rifle by suitable mount means 18. The telescope gunsight has the conventional cross hair sighting means therein, not shown, adjustable vertically and horizontally by adjustment means 20.

The improved sighting in apparatus includes a sighting gauge 22, FIGS. 1 through 6, of the shape in side elevation as best illustrated in FIGS. 1, 3 and 4. This gauge has an upper full width portion 24, a lower full width portion 26, and intermediate cut-out portions 28, FIG. 5, on each side leaving an upright interconnecting wall 30. The upper portion 24 has a V-shaped slot 32 extending longitudinally through the gauge and arranged to receive a round rod 34 therein. This rod is of a selected diameter such that it will fit in the muzzle end of the gun barrel. The rod is clamped in the slot 32 by a thumb screw 36 extending threadedly down through the gauge from the top and arranged for engagement at its lower end with the rod.

The lower end portion of the gauge 22 has a longitudinal bore 38 extending inwardly from the front, and this bore has a counter-weight 40 therein whereby with the rod 34 rotatably supported in the muzzle of the gun, the gauge will act as a pendulum and hang upright. The fit of the rod in the barrel is such that while it is freely rotatable therein, it does not have any substantial lateral play so that accuracy is maintained. The removable and adjustable attachment of the rod to the gauge and the use of the V-shaped slot 32 allows for substitution if necessary of a selected size and length of rod to accomodate selected rifles.

The front edge of the gauge 22 has an upright groove 42 therein leading down from the top and slidably receiving a sighting target 44. This target is held adjustably in the groove by upper inturned flange portions 46, FIG. 6, as well as a lower thumb screw 48 passing through an elongated slot 50 in the sighting target and threadedly engaged in the sighting gauge, the wall 30 having a boss 52 for threadedly receiving the screw 48. Sighting target 44 has an upper elongated slot 54 through which the support rod 34 extends.

Sighting target 44 has fine adjustment in the groove 42 by an adjusting screw 56 threadedly mounted in a bottom forwardly extending flange 58. The upper end of this adjusting screw is rotatably received in a forwardly extending flange 60 on the bottom of the sighting target 44, and such screw has a peripheral groove 62 receiving the tip end of a retaining screw 64 threadedly engaged through one side of the flange 60. It is apparent that upon selected adjustment of the screw 56, vertical positioning of the sighting target 44 is accomplished, the thumb screw 48 first being loosened and then tightened when the adjustment has been accomplished.

The front surface of the sighting target 44 has intersecting vertical and horizontal reference lines 66 and 68, respectively, the vertical line 68 being precisely centered in relation to the axis of the support rod 34.

In the sighting in position of the gauge 22, the rod 34 is inserted in the muzzle end of the gun barrel as shown in FIG. 1. With the pendulum action of the gauge, it will hang straight vertically whereby the telescope gunsight can be adjusted such that its cross hairs have the desired alignment relative to the intersection of lines 44 and 46. Prior to use of the gauge in the field, the sighting target 44 is selectively adjusted for the proper sighting of the gunsight, such set adjustment being accomplished at the factory as associated with a selected type of gunsight and the selected type of gun on which the gunsight is to be used, or the owner of the gun can adjust the sighting target 32 to the selected position by suitable targeting. Once the position of the sighting target has been fixed, sighting of the gunsight can thereafter be conveniently and speedily checked merely by temporarily mounting the gauge 22 on the muzzle end of the barrel.

Since telescope gunsights are focused for substantially long distances, it is desired that the present apparatus include focusing means arranged to be removably attached to the front end of the telescope. The focusing means as well as aligning means is shown in detail in FIGS. 7 through 10 and comprises a chuck-type holder 72 having three or more jaws 74 with head portions 76 arranged for slidable engagement in slotted extensions 78 in the holder and having beveled inwardly facing surfaces 80 for engaging the telescope. Head portions 76 have side grooves 82 engageable with guide projections 84 in the slotted extensions 78.

Holder 72 has a front extension 86 rotatably supporting a drive member or scroll 88 having a spiral groove 90 on its rear surface engageable with projecting teeth 92 on the jaws, the arrangement being such that upon rotation of the drive member, the jaws 74 are moved radially, thus permitting the holder to be attached to different size telescopes. The extensions 78 of the holder 72 are of sufficient length to fully enclose the heads 76 even to the outermost position of the latter, and a stop pin 93 is provided at the outer end of one of the extensions engageable by that jaw to limit outward movement of the jaws. This pin prevents displacement of the jaws from the holder.

The drive member 88 is held in place by a retaining washer 94 in turn held in place by a lock ring 96.

Holder 72 and its extension 86 have a central bore 98 with a front counterbore 100 adapted to receive an insert 102 in a snug but removable fit. This insert has a front socket housing a lens 104 therein held in place by an open center retaining cap 106. The lens is refracted to provide a clear focused viewing of the sighting target 44. To accommodate guns of varying barrel length, the sighting gauge may be brought into focus by adjusting the rod 34 lengthwise in the barrel, although by selected positioning of the rod in the sighting gauge, a fixed position of the rod in the gauge is maintained once it is set for the particular gun. The chuck-type holder using the scroll 88 provides accurate centering support of the lens on the telescope.

To provide greater accuracy in sighting in the telescope, a second insert 108 having a head portion 110, is provided that has a removable fit in the central bore 98 at the rear of the holder, and to provide such increased accuracy, this insert has an axial bore or peep-hole 112 of small diameter. This peep-hole narrows the line of sight through the telescope and provides said greater accuracy for sighting in the telescope. A compass 114 may be mounted in an aperture 116 provided in wall portion 30 of the gauge if desired, such a compass being shown in place in FIG. 4 but removed from FIGS. 3 and 5.

Figure 11:
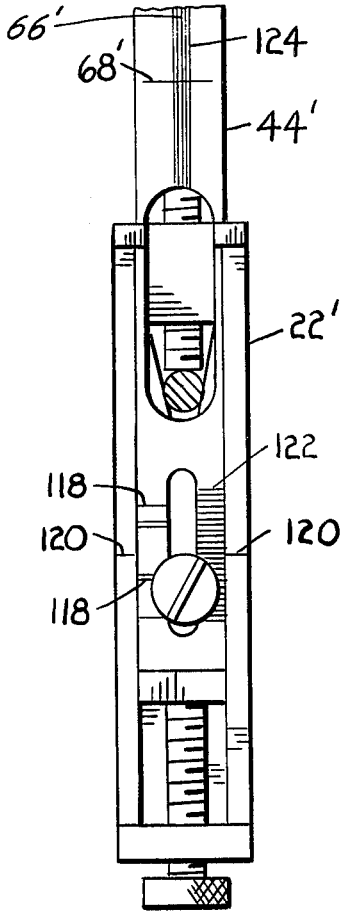
FIG. 11 is a front elevational view of a modified form of sighting gauge.

With particular reference to FIG. 11, a second form of sighting target 44' is illustrated which has selected markings thereon facilitating convenient adjustment of the target 44' to provide accuracy for different height scope mounts and different bore calibers. That is, the sighting relationship and elevation of trajectory will of course vary from one height of scope mount to another and from one bore caliber to another.

In order to provide accuracy for these variables throughout the shooting range of a rifle, the sighting target 44' is provided with guide means which when used in the steps of sighting in the telescope, automatically compensate for such variables.

Such guide means comprise selectively located horizontal guide lines 118 on the face of the sighting target 44' associated with horizontally aligned stationary reference marks 120 on the guage 22'. Lines 118 are empirically located such that after reference line 68' of the sighting target 44' is aligned with the horizontal line in the scope, adjustment for scope height and bore caliber of the gun is accomplished by moving the sighting target up or down to match the closest line 118 with reference marks 120. The lines 118 as located empirically and being six in number provide setting for varibles which will exist in all conventional scope mount heights and bore calibers.

Additional lines 122 provided on the sighting target 44' in association with lines 118 provide reference means for adjustment which may or may not be associated with lines 118. In addition, the sighting target of FIG. 11 is provided with additional vertical reference lines 124 on each side of vertical line 66' for greater convenience and accuracy of alignment.

According to the present invention, sighting in apparatus is provided which can be conveniently carried by the gun owner and which can be readily mounted on the gun when he desires to sight in his telescope or to check it. The gauge may simply be used together with the lens 104 for general sighting in and if greater accuracy is desired the insert 108 may be installed. The diameter of head 110 of insert 108 is of a dimension such that this insert may be placed head first into the counterbore 100 at the front end of the holder. Thus, if even greater accuracy is desired than with the use of the arrangement shown in FIG. 7, a second holder 72 may be attached to the rear of the telescope with an insert 108 being installed head first in the counterbore 100 instead of a lens insert 102. A peep-hole insert 108 is thus provided at the eyepiece end of the telescope and is used in combination with a holder at the front of the telescope having the lens insert 102 and peep-hole insert 108, thus providing increased accuracy in sighting in on the sighting target 44.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. Sighting in apparatus for rifle mounted telescope gunsights comprising (a) a sighting gauge having top and front edges, (b) rod-like support means having one end portion secured to said sighting gauge and arranged at its other end to be rotatably received in the muzzle end of a rifle barrel, (c) said gauge being counterweighted at its lower portion to form a pendulus support for the gauge on the support means and hold it vertical when the support means is supported in the muzzle end of a rifle, (d) a sighting target mounted on the front edge of said gauge having intersecting vertical and horizontal reference lines to be used in sighting in the telescope gunsight, (e) lens means arranged to focus the gunsight to the sighting target when the latter is supported on the muzzle end of the barrel, (f) a holder having a bore extending from front to rear thereof, (g) an insert at the front of said holder supporting said lens means in said holder, (h) a plurality of chuck-type jaws on said holder having radial movement for engaging a gunsight and holding said holder on gunsight to sight in a rifle by means of said sighting gauge, (i) and a manually operated rotatable drive member having a spiral groove in which said teeth are engaged and arranged when rotated to move said jaws radially in symmetrical movement for mounting said holder precisely on a gunsight from one time to the next.

2. The sighting in apparatus of claim 1 wherein the securement of said rod-like support means to said sighting gauge comprises means defining a longitudinal slot through said gauge adjacent the upper end thereof, said slot being V-shaped in a vertical direction and arranged to receive the other end portion of said rod-like support means, said slot being enlarged relative to said rod-like support means for accommodating different diameters of said rod-like support means, and screw means threadedly engaged in said gauge from the top and projecting into said slot for end engagement with said rod-like support means to hold the latter securely on said gauge.

3. The sighting in apparatus of claim 1 wherein said bore in said holder has a front counterbore and said second insert has a head the diameter of which permits said second insert to be removably held head first in said counterbore.

4. The sighting in apparatus of claim 1 including a second insert at the rear of said holder having a peephole for cooperation with the sighting means of a telescope gunsight and said sighting target for sighting in the gunsight.

5. The sighting in apparatus of claim 1 including horizontal reference means on said sighting target arranged to adjust the telescope in elevation to compensate for the spacing of the telescope from a gun on which it is mounted and for bore calibers.

* * * * *